US007306121B2

(12) United States Patent
Ophardt et al.

(10) Patent No.: US 7,306,121 B2
(45) Date of Patent: Dec. 11, 2007

(54) GOOSENECK SQUEEZABLE DISPENSER

(75) Inventors: Heiner Ophardt, Vineland (CA); Abdul Vali Syed, Stoney Creek (CA)

(73) Assignee: Hygiene-Technik Inc., Beamsville, Ontario (CA)

( * ) Notice: Subject to any disclaimer, the term of this patent is extended or adjusted under 35 U.S.C. 154(b) by 417 days.

(21) Appl. No.: 11/084,181

(22) Filed: Mar. 21, 2005

(65) Prior Publication Data

US 2006/0208003 A1 Sep. 21, 2006

(51) Int. Cl.
*B65D 37/00* (2006.01)

(52) U.S. Cl. ..... 222/209; 222/214; 222/566

(58) Field of Classification Search ..... 222/209, 222/214, 215, 526, 545, 566, 212; D9/373, D9/374, 404, 410
See application file for complete search history.

(56) References Cited

U.S. PATENT DOCUMENTS

| | | | | |
|---|---|---|---|---|
| 2,760,687 A | | 8/1956 | Spier | |
| 2,987,261 A | * | 6/1961 | McCuiston et al. | 239/304 |
| 4,437,587 A | * | 3/1984 | Duering | 222/207 |
| 4,600,128 A | * | 7/1986 | Rohrer | 222/108 |
| 4,846,599 A | * | 7/1989 | Seddon | 401/202 |
| D310,960 S | * | 10/1990 | Verebelyi | D9/526 |
| 5,356,053 A | * | 10/1994 | Di Fatta | 222/456 |
| 5,582,315 A | | 12/1996 | Reid | |
| 5,975,372 A | * | 11/1999 | Heyn | 222/181.3 |
| D426,300 S | | 6/2000 | Conforti | |
| D470,416 S | | 2/2003 | Blair | |
| 2003/0057235 A1 | | 3/2003 | Gueret | |

FOREIGN PATENT DOCUMENTS

| | | |
|---|---|---|
| DE | 4241137 | 9/1994 |
| EP | 601487 | 2/1993 |

* cited by examiner

*Primary Examiner*—Lien M. Ngo
(74) *Attorney, Agent, or Firm*—Riches, McKenzie & Herbert LLP

(57) ABSTRACT

A plastic squeeze container for dispensing a fluid carrying a turret member rotatably mounted to the container for movement to a plurality of different rotational positions with the turret member carrying an outlet through which fluid may be dispensed generally along an outlet axis and with rotation of the turret member the outlet axis varying as to the angles it assumes relative to a vertical axis of the container.

22 Claims, 18 Drawing Sheets

32
16
73
48
14
31
44
25
43
24
12
19
22
38
37
34
B
33

28
11
102
A
23
18
20
21

14
16
49
45
12
24
22
28
11

16
54
55
12
22
28
11

GOOSENECK SQUEEZABLE DISPENSER

SCOPE OF THE INVENTION

This invention relates to plastic squeeze bottles and particularly to plastic squeeze bottles that are adapted to be held inverted and dispense fluid upwardly.

BACKGROUND OF THE INVENTION

Plastic squeeze bottles for dispensing cleaners are known which have a gooseneck appearance and are adapted to be held when inverted such that the nozzle will direct fluid upwardly as under the rim of a toilet bowl. One problem with such gooseneck bottles is that the filling neck of the bottle is disposed at an angle to the vertical when the bottle is standing on its base. This has been appreciated by the inventors of the present application to present problems during filling operations since many assembly lines for automated filling require the filling neck to be disposed vertically.

Known squeeze bottles for dispensing cleaners when inverted suffer the disadvantage that typically the nozzle at which fluid is to be directed is fixed relative to the reminder of the contain and that manual dexterity of a user is required to permit dispensing in a variety of directions.

SUMMARY OF THE INVENTION

To at least partially overcome these disadvantageous of previously known devices the present invention provides an improved container which includes features of having a filling neck which extends vertically when the container is in an inverted position and with the container having an outlet which is directed laterally toward one side and/or a container having a turret member carrying a outlet which turret member is adapted to be pivotally mounted to the container for rotation about a pivot axis at an angle to the vertical with an outlet carried on the turret member disposed at an angle to the pivot axis.

In one aspect the present invention provides a plastic squeeze container for dispensing from an outlet when squeezed including a filling neck which extend substantially vertically when the bottle is in an upright position supported on its base and with the filling neck closed by a gooseneck extension which delivers fluid from the filing neck to a nozzle directed at an angle to the vertical.

In another aspect the present invention provides a plastic squeeze container for dispensing a fluid carrying a turret member rotatably mounted on the container for movement to a plurality of different rotational positions with the turret member carrying an outlet through which fluid may be dispensed generally along an outlet axis and with rotation of the turret member the outlet axis varying as to the angles it assumes relative to a vertical axis of the container.

In another aspect the present invention provides an improved container for toilet bowl cleaning fluid which container is inverted and squeezed to dispense the fluid.

BRIEF DESCRIPTION OF THE DRAWINGS

Further aspects and advantageous of the present invention will become apparent from the following description taken together with the accompanying drawings in which.

DETAILED DESCRIPTION OF THE DRAWINGS

Figure 1:
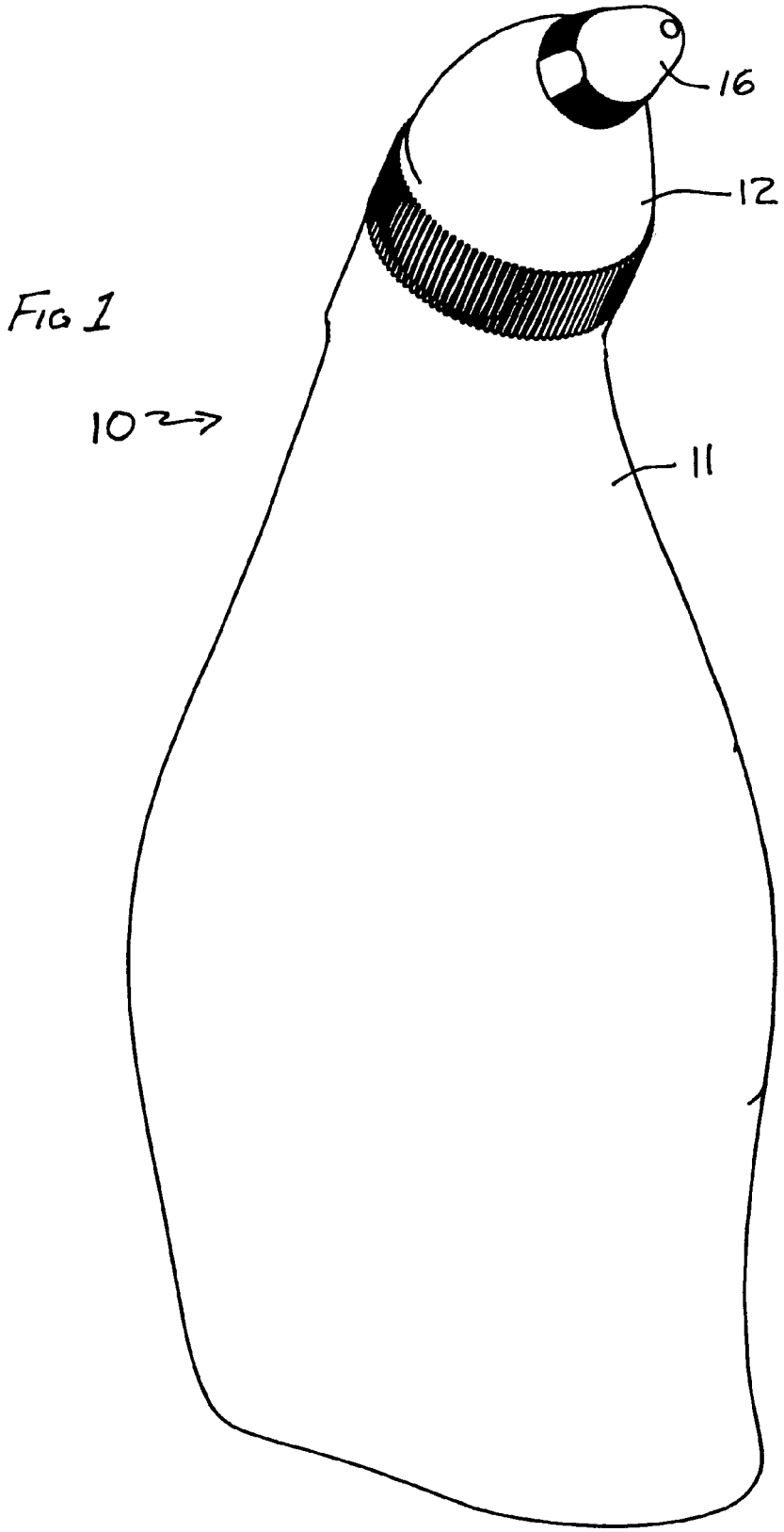
FIG. 1 is a perspective view of a container in accordance with a first embodiment of the present invention.

Reference is made to FIGS. 1 to 11 showing first embodiment of a container 10 in accordance with the present invention and comprising a bottle 11 with a turret member 12 mounted on its upper end, with a connection tube 14 communicating fluid from inside the bottle to an outlet in the turret member 12 and with a removable closure cap 16 secured to the turret member 12.

Figure 2:
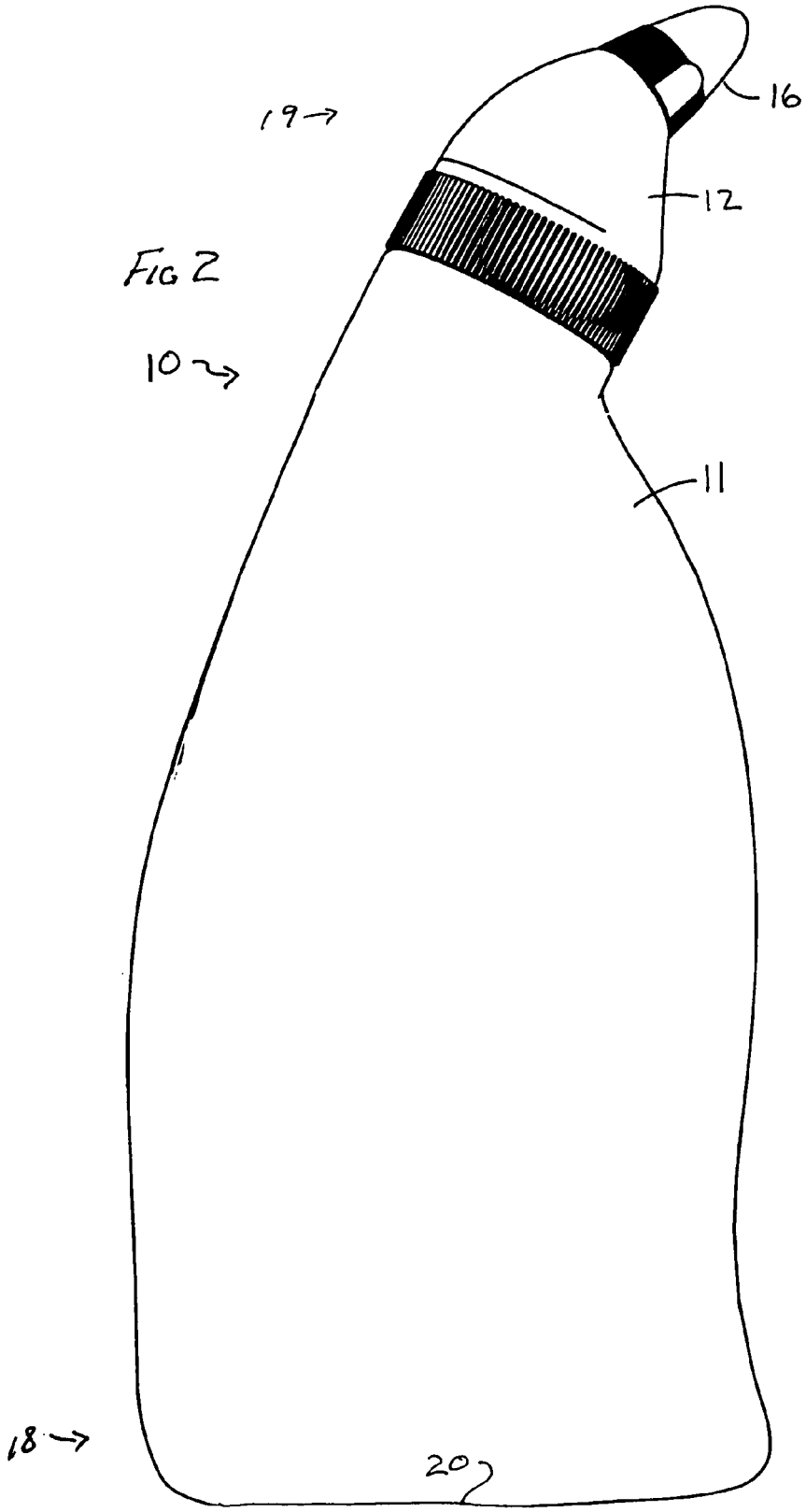
FIG. 2 is a side view of the container of FIG. 1.
Figure 3:
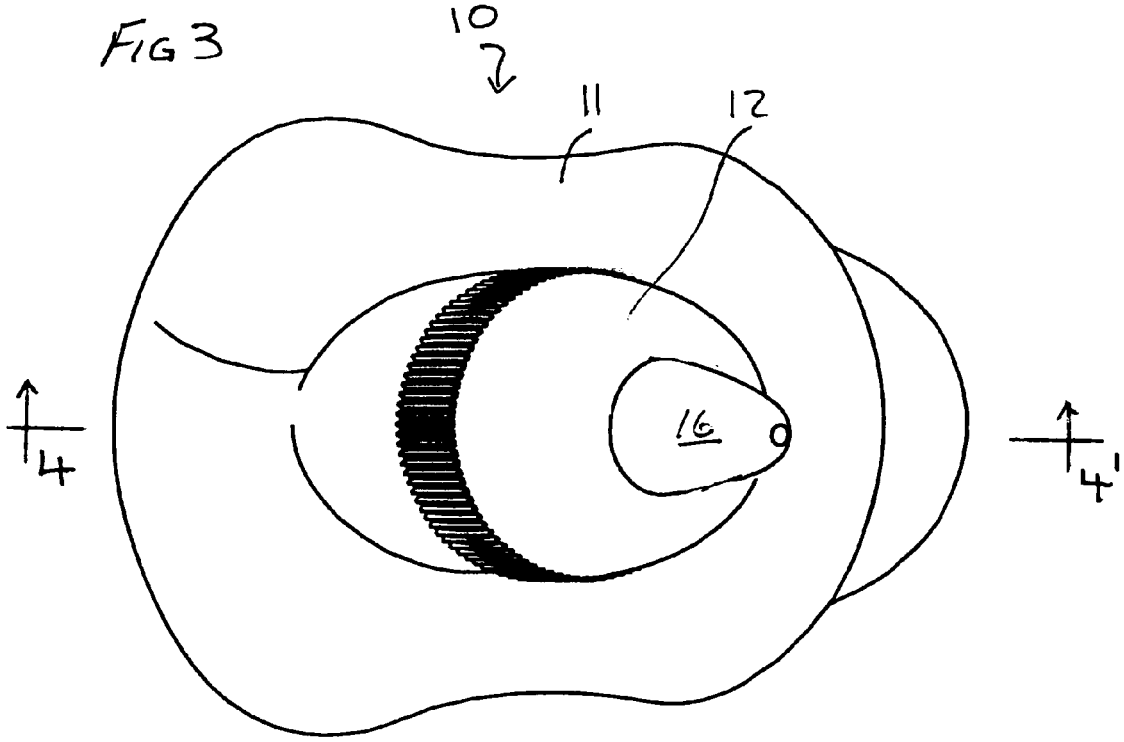
FIG. 3 is a top view of the container of FIG. 1.

The bottle 11 is shown in FIGS. 1, 2 and 3 in an upright position. The bottle has a lower end generally indicated 18 and an upper end generally indicated 19. The bottle has a base 20 at its lower end 18 which is adapted to support the bottle 11 as on a flat surface shown as 21 only in FIG. 4 so as to maintain the bottle 11 in the upright position with the upper end 19 of the bottle extending upwardly from the base 20. The bottle has a filling neck 22 at the upper end 19 of the bottle. The filling neck 22 is shown to extend vertically upwardly about a vertical axis 23 when the bottle is in the upright position as shown. The filling neck 22 is open to the interior of the bottle and ends at an upper open end 24. The filling neck 22 is shown as provided with threads 25 about its cylindrical periphery as been seen in FIG. 5. A support collar 26 is provided on the bottle 11 at the upper end 19 of the bottle about the filling neck 22. The support collar 26 is coaxial about a pivot axis 28 which is disposed so as to form an acute angle indicated as "A" in FIG. 4 to the vertical axis 23.

Figure 4:
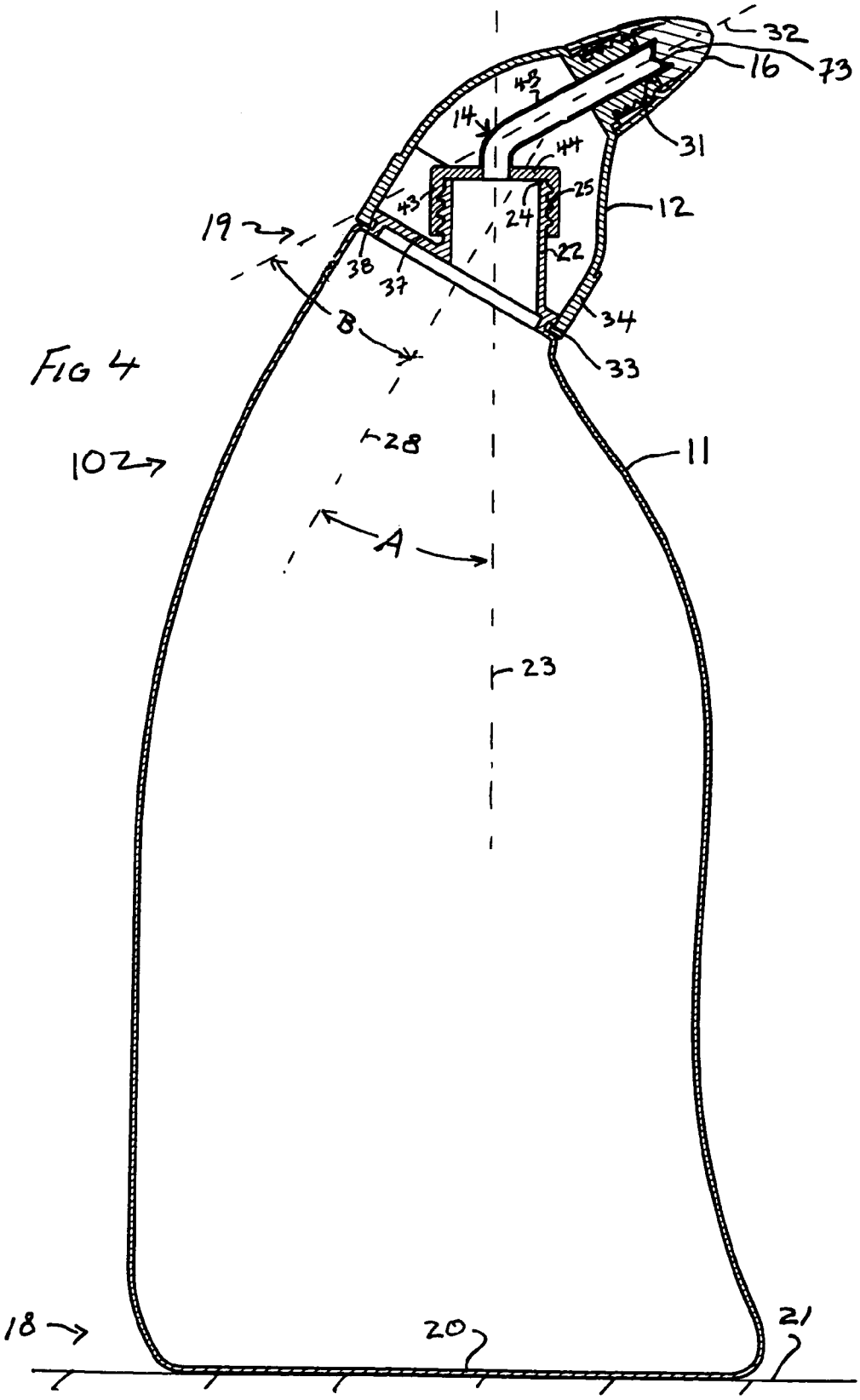
FIG. 4 is a cross-sectional side view of the container of FIG. 1 along section line 4-4' in FIG. 3.
Figure 5:
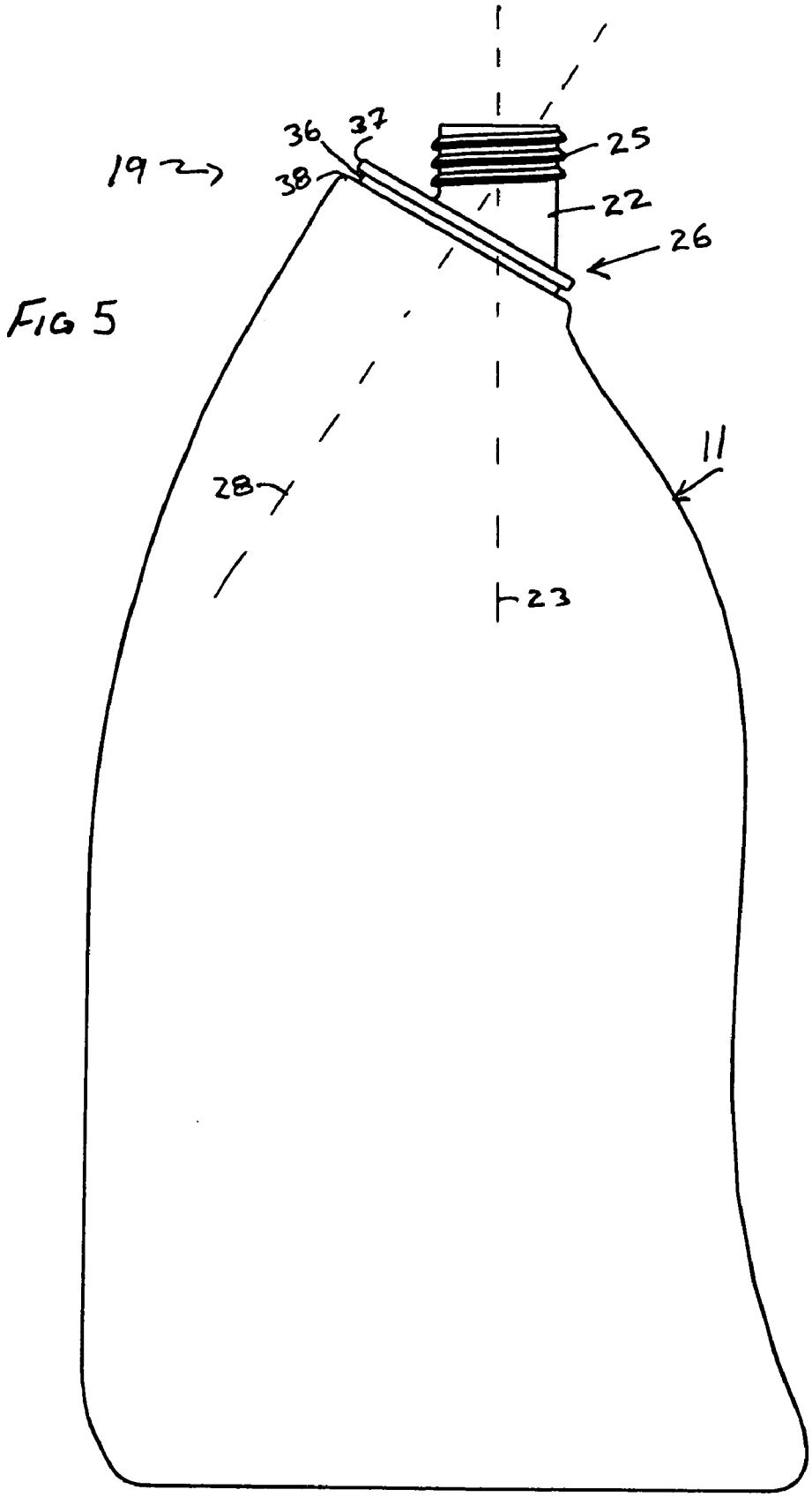
FIG. 5 is a side view of the bottle of the container of FIG. 1.
Figure 6:
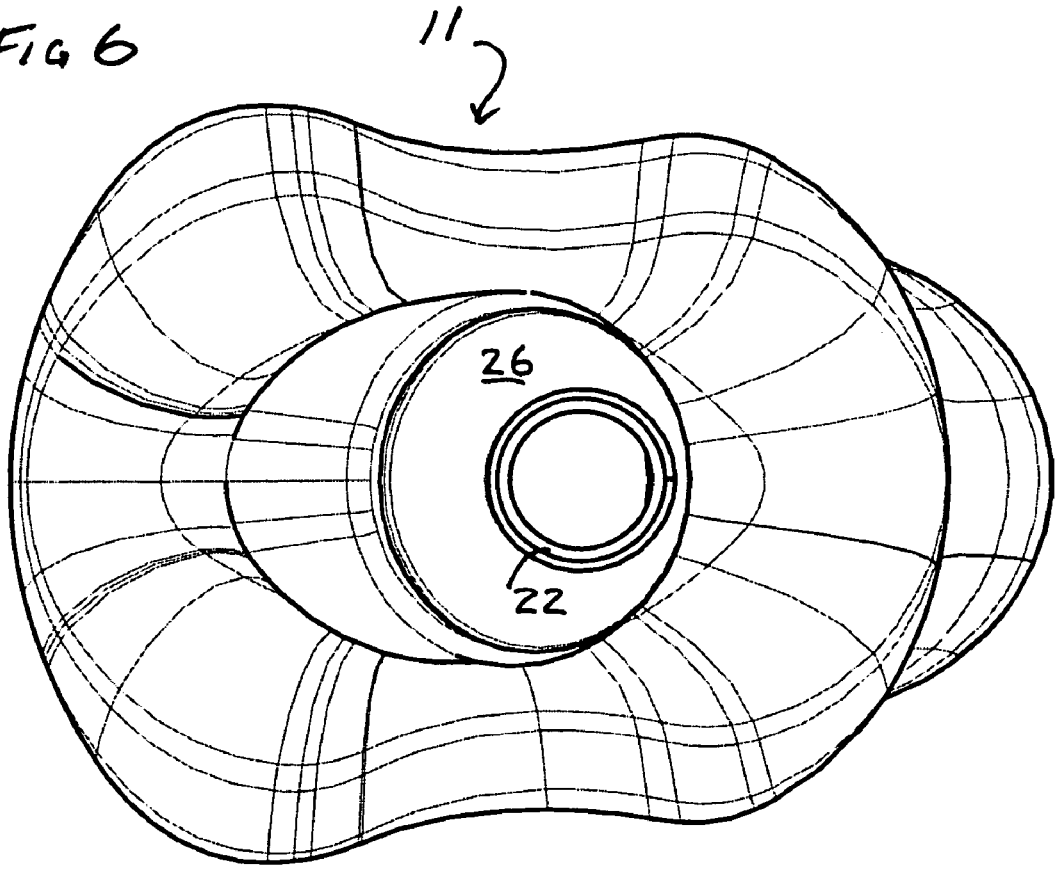
FIG. 6 is a top view of the bottle of FIG. 5.

The filling neck 22 and the support collar 26 are readily seen in cross in FIG. 4 as well as in side and top views in FIGS. 5 and 6.

Figure 8:
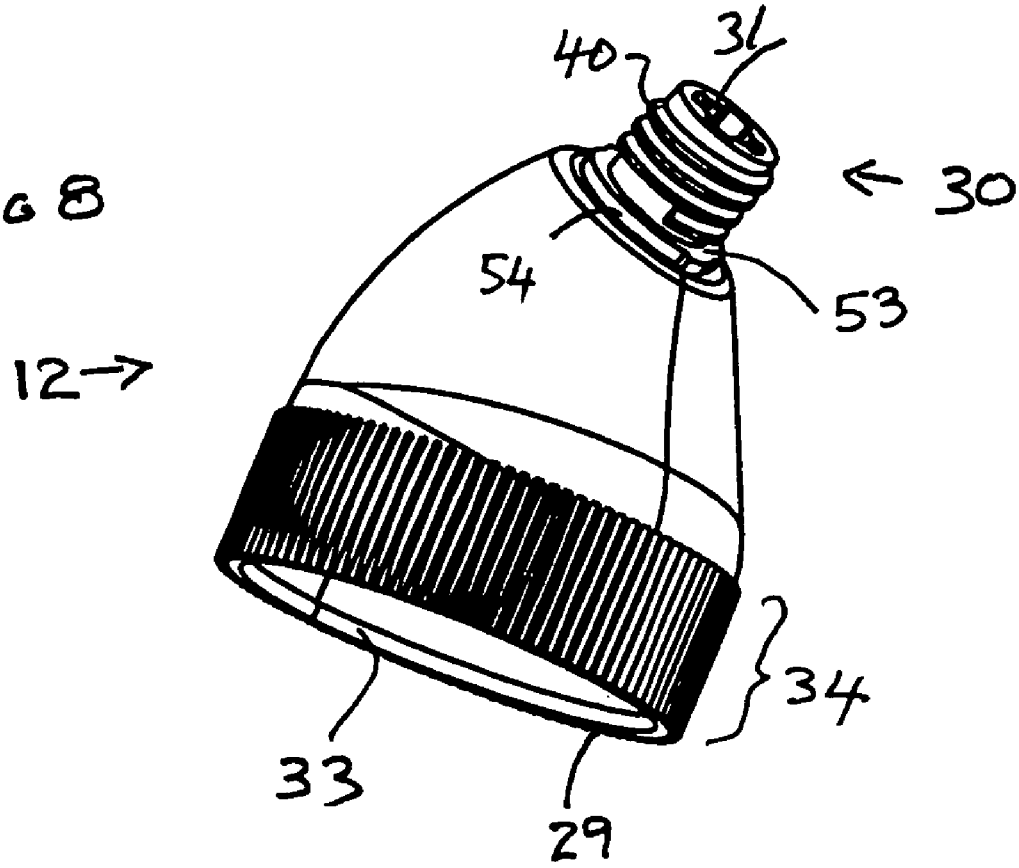
FIGS. 8 and 9 are pictorial views of a turret member for the container of FIG. 1.
Figure 9:
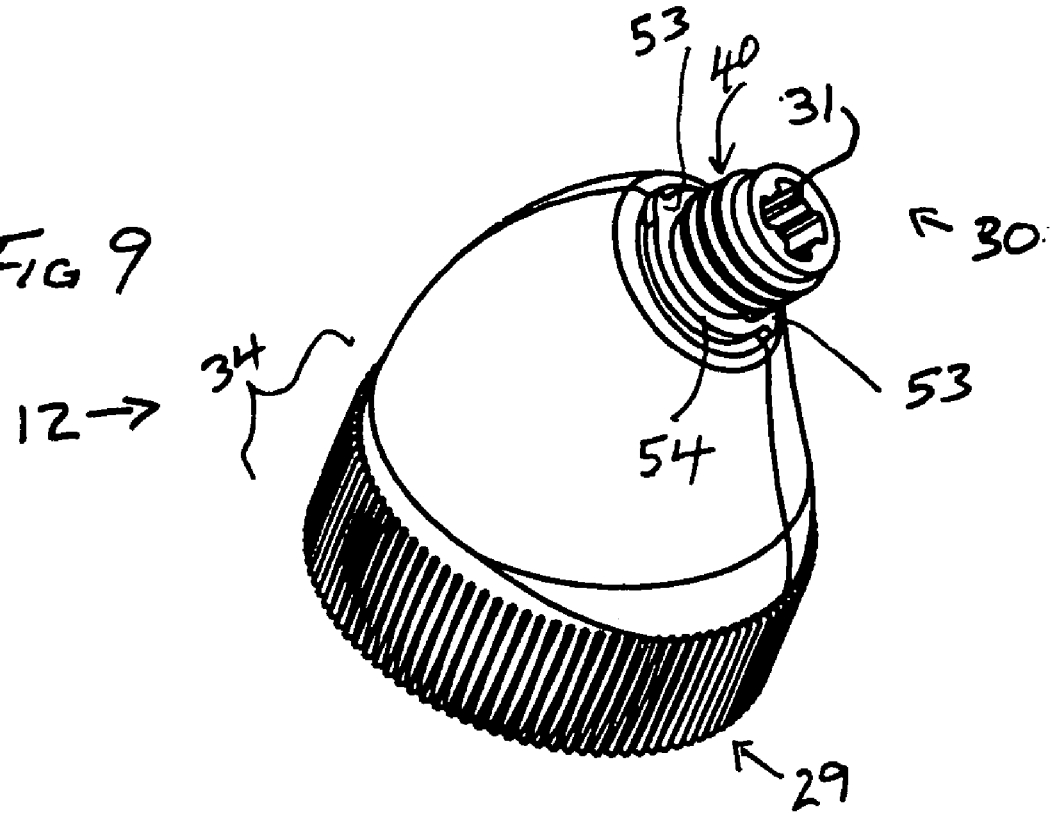

The turret member 12 is shown in pictorial views in FIGS. 8 and 9. The turret member 12 extends from an open lower end 29 to an upper end 30. The upper end 30 of the turret member 12 carries a turret outlet 31 which is disposed about an outlet axis 32 shown in FIG. 4. The lower end 29 of the turret member is mounted on the support collar 26 of the bottle 11. The turret member 12 is seen as enclosing and covering the filling neck 22. A lower end 29 of the turret member 12 is circular in cross section and disposed to be mounted on the support collar 26 coaxially to the support collar 26 and the pivot axis 28 such that the turret member 12 is journalled for rotation relative the support collar 26 about the pivot axis 28. In this regard, the lower end 29 of the turret member 12 is shown as being formed as a generally cylindrical annular ring portion 34 which includes proximate the lower end 29 an annular radially inwardly extending boss 33 which is adapted to be received in an annular channel 36 formed on the support collar 26. The support collar 26 can be seen in FIG. 5 as having an upper plate 37 and a lower shoulder 38 with the channel 36 formed therebetween. Each of the channel 36, plate 37 and shoulder 38 are of circular cross-section and coaxial about the pivot axis 28. The turret member 12 may be secured to the collar 26 in a snap fit relation against easy removal. The turret member 12 may frictionally engage the collar 26 so as to resist rotation other than when manually moved to a new rotational position. Providing frictional resistance to rotation is preferred so that the turret member 12 will remain in desired position once manually placed there.

The cylindrical ring portion 34 of the turret member 12 is provided with a plurality of axially extending ribs and grooves so as to provide a knurled appearance and assist in providing a surface for manual engagement to facilitate a person manually rotating the turret to different relative positions relative to the bottle about the pivot axis 28.

The turret member 12 is a hollow tubular member tapering from its open lower end 29 to its upper end 30 which as best shown in FIGS. 8 and 9 carries the turret outlet 31. The upper end 30 of the turret member 12 provides a turret neck 40 which carries external threads. The turret member 12 may be roughly characterized as being a hollow tubular member of generally curved horn-type shape. A center line conceptionally extends through the turret member along its length which center line is asymmetrical relative the pivot axis and about which the turret member is roughly coaxial, that is generally circular in any cross-section normal to the center line.

Figure 7:
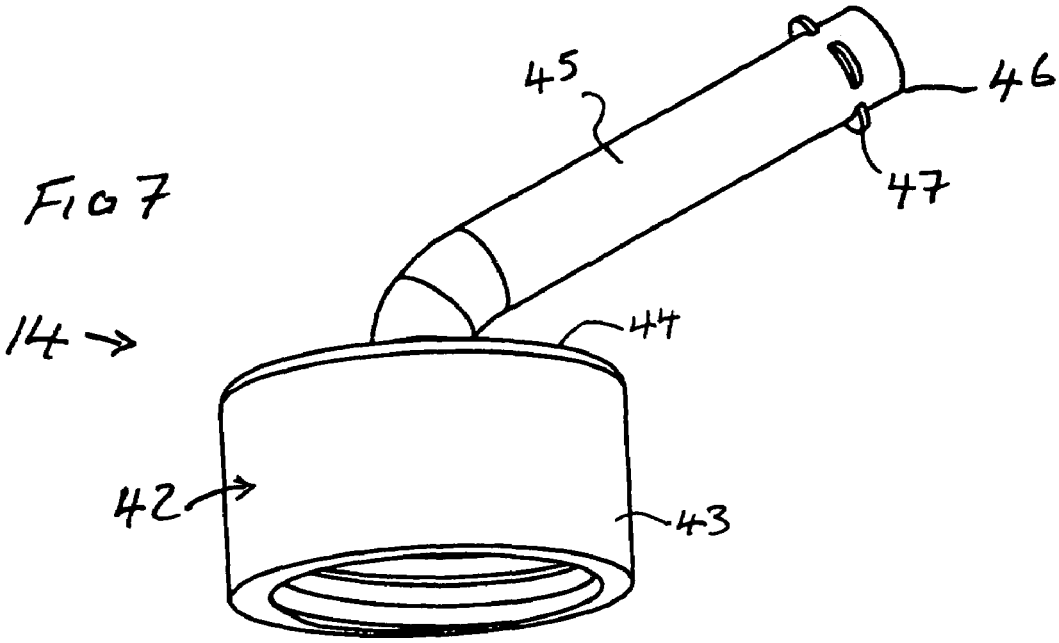
FIG. 7 is a pictorial view of a connection tube for the container of FIG. 1.

The connection tube 14 is shown in pictorial view in FIG. 7. As seen in cross-section in FIG. 4, the connection tube 14 is secured to the filling neck 22 and provides for communication from the open end 24 of the filling neck to the turret outlet 31. In this regard, the connection tube 14 has a cap-like inner end member 42 with a cylindrical interiorly threaded side wall 43 and end wall 44. The cap-like member 43 is adapted to be threaded onto the filling neck 22 in sealed relation. A flexible tube member 45 extends from the cap-like member 42 and is preferably integrally formed therefrom. The tube member 45 is resilient and flexible. The tube member 45 is shown as comprising a cylindrical tube having at its outlet end 46 four ear-flange members 47 which extend radially outwardly from the tube member 45 proximate the outlet end 46. These ear-flange members 47 are resilient and provide a means for connecting the tube member 45 to the turret outlet 31. In this regard, as seen in FIG. 9, the turret outlet 31 is provided to have a cross-section which is not cylindrical but rather has four protrusions which extend inwardly to provide an "X" or cross-like shape in cross-section. The outlet end 46 of the tube member 45 is resilient and can be forcibly urged from inside of the turret member 12 through the turret outlet 31. However, once the ear-flanges 47 pass through the turret outlet 31, they cannot readily be drawn back through the turret outlet 31 and the ear-flanges 47 assist in ensuring that the tube member 45 is not drawn back inwardly into the turret member 12.

Figure 10:
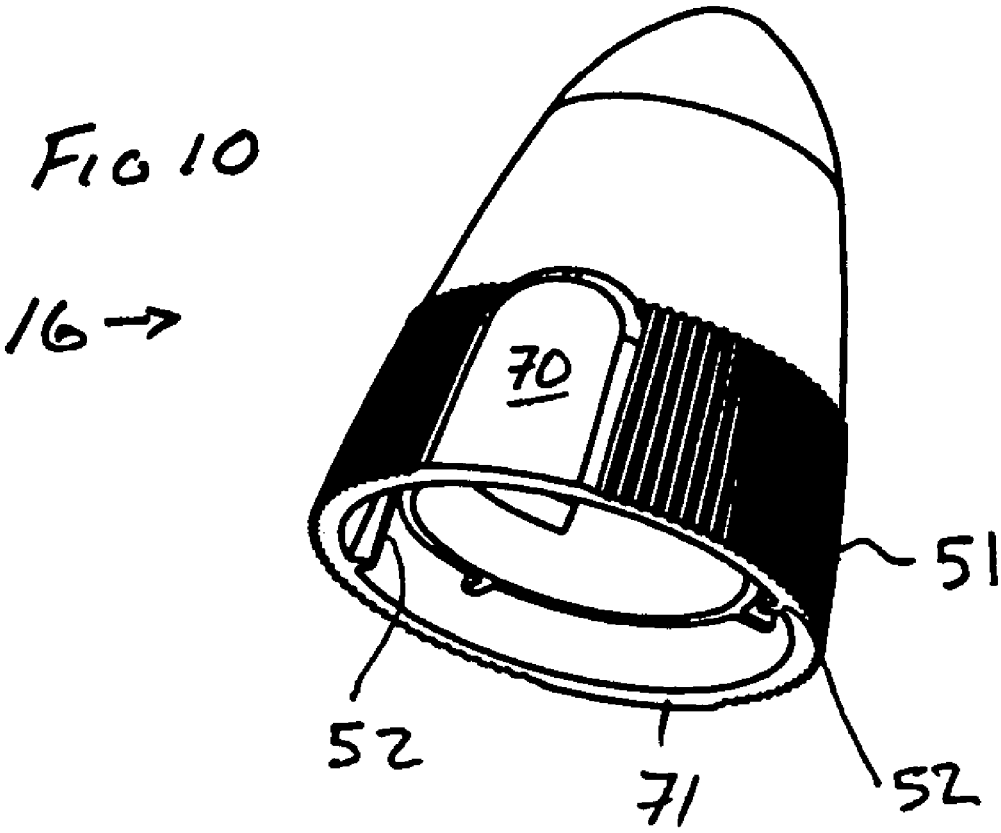
FIGS. 10 and 11 are pictorial views of a closure cap for the container of FIG. 1.
Figure 11:
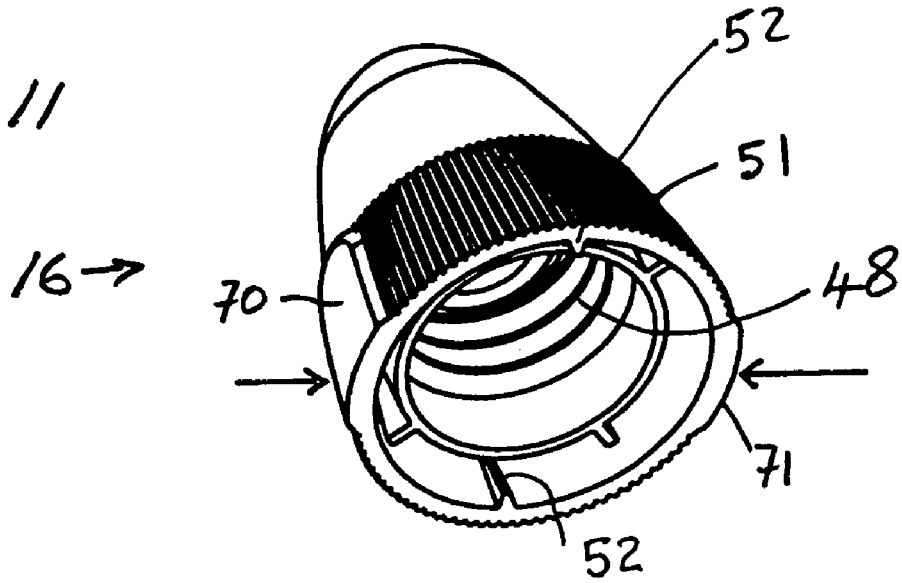

The closure cap 16 is best described with reference to FIGS. 4, 10 and 11. The closure cap 16 has internal threads 48 for engagement with the threads on the turret neck 40 of the turret member 12. The closure cap 16 has a lower most almost cylindrical annular ring 51 which on its internal surfaces carries radially inwardly and axially extending catch vanes 52 which are adapted to engage on two catch arms 53 carried on the turret member 12 on a shoulder 54 at the base of the turret neck 40 and which catch arms 53 extend radially outwardly. On threading the closure cap 16 onto the turret neck 40, the catch vanes 52 are cammed to ride over the catch arms 53 when the cap is rotated in a clockwise tightening direction. When the closure cap 16 is attempted to be removed by rotation in a counter clockwise direction, the catch vanes 52 on the closure cap 16 engage on the arms 53 on the turret neck 40 and prevent rotation counter-clockwise and therefore opening. To remove the closure cap 16, a person must manually apply compressive forces to the cap 16 onto diametrically release surfaces indicated as 70 and 71 on the ring 51 in the direction indicated by the arrows in FIG. 11 so as to deform the generally annular ring 54 to assume an elliptical shape such that the catch vanes 52 are moved radially outwardly sufficiently that they will not engage the catch arms 53, when the closure cap 16 is rotated. While a preferred child safety closure cap 16 is shown which resists removal of the cap by children, it is to be appreciated that this is not necessary. A normal closure cap may be provided instead. As well, many other different types of childproof closure caps may be used.

As best seen in FIG. 4, when the closure cap 16 is fully seated on the turret neck 40, the closure cap 16 seals the outlet end of the tube member 25 against fluid flow therethrough as by a central conical stop 73 on the closure cap 16 engaging into the outlet end of the tube member 25 urging the tube member 25 into the turret outlet 31 for sealed engagement.

The preferred closure cap 16 is removable by manual rotation and removal so as to permit fluid to be dispensed from the container.

Each of the turret member 12, connector tube 14 and the closure cap 16 may preferably be injection molded by plastic. The bottle 11 is preferably blow molded for plastic.

Figure 12:
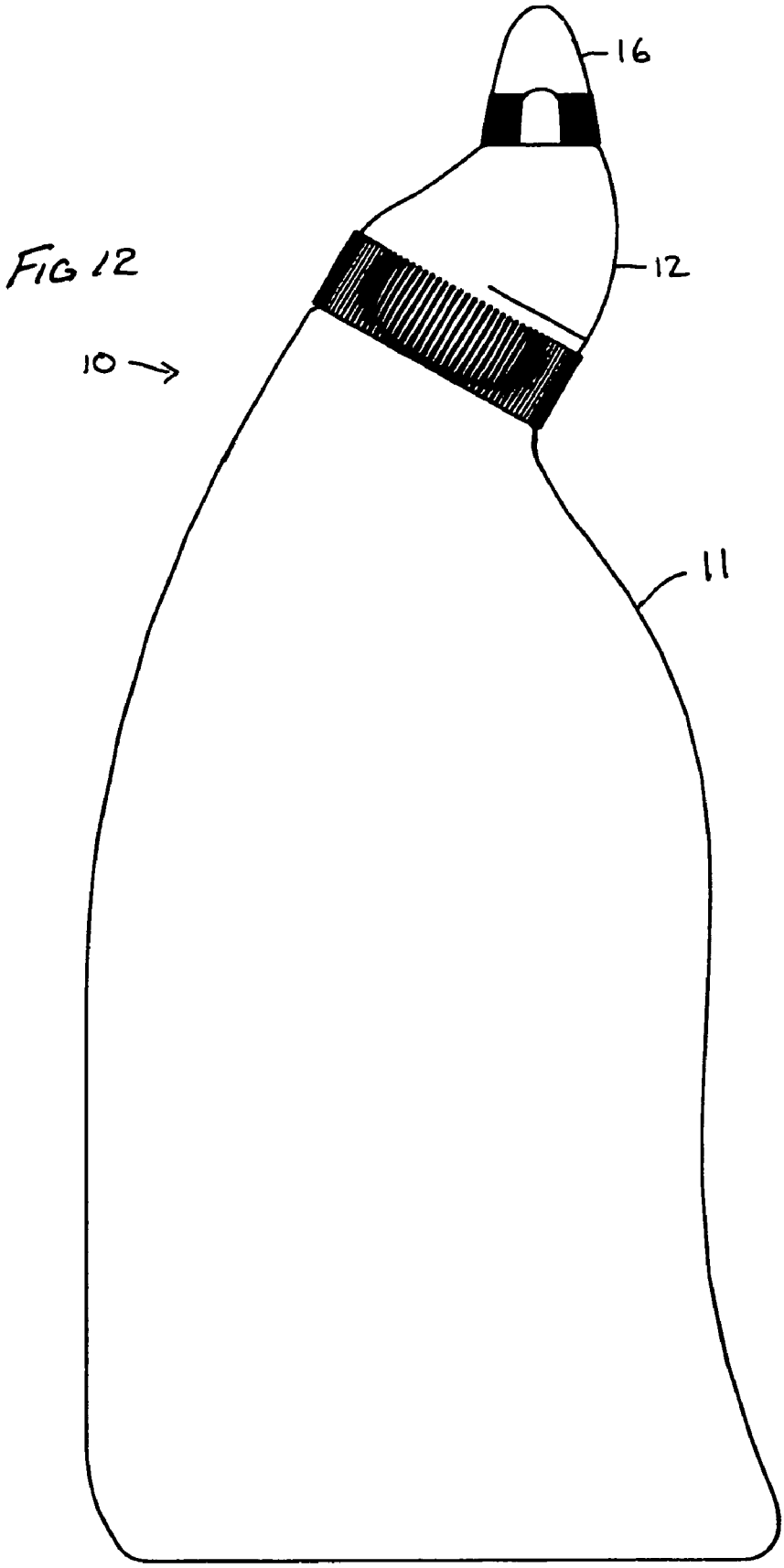
FIG. 12 is a side view similar to FIG. 2 but with the turret member rotated 90° from the position shown in FIG. 2.
Figure 13:
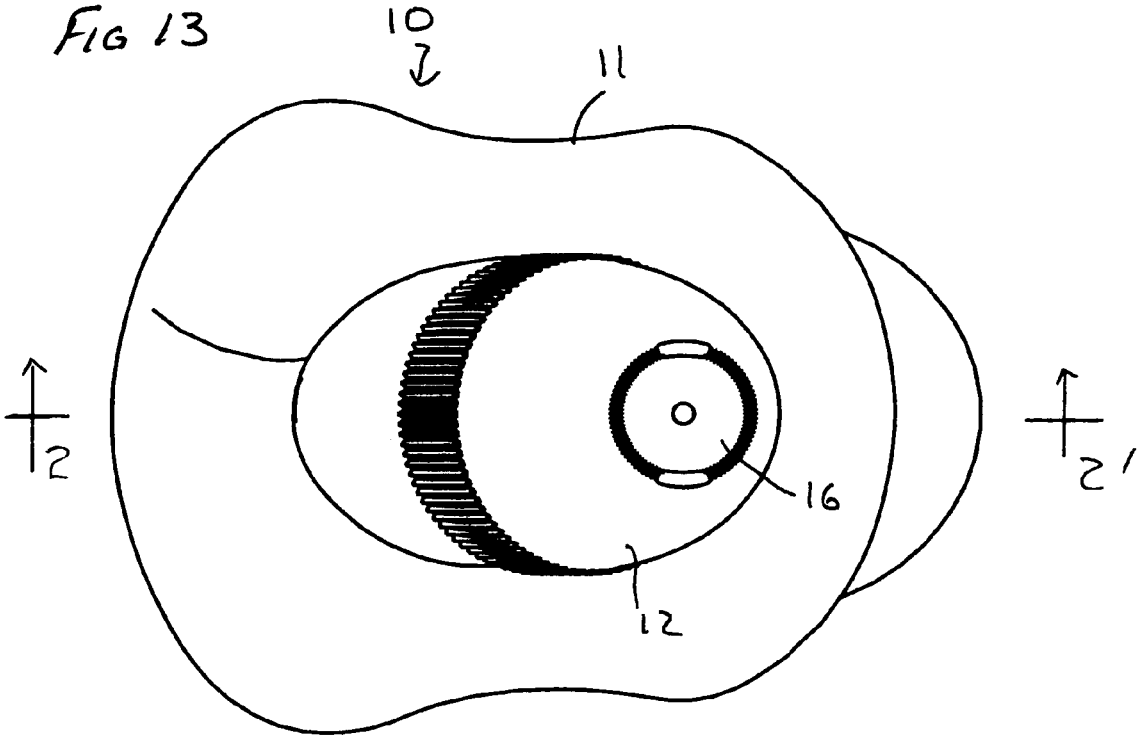
FIG. 13 is a top view of the container of FIG. 12.
Figure 14:
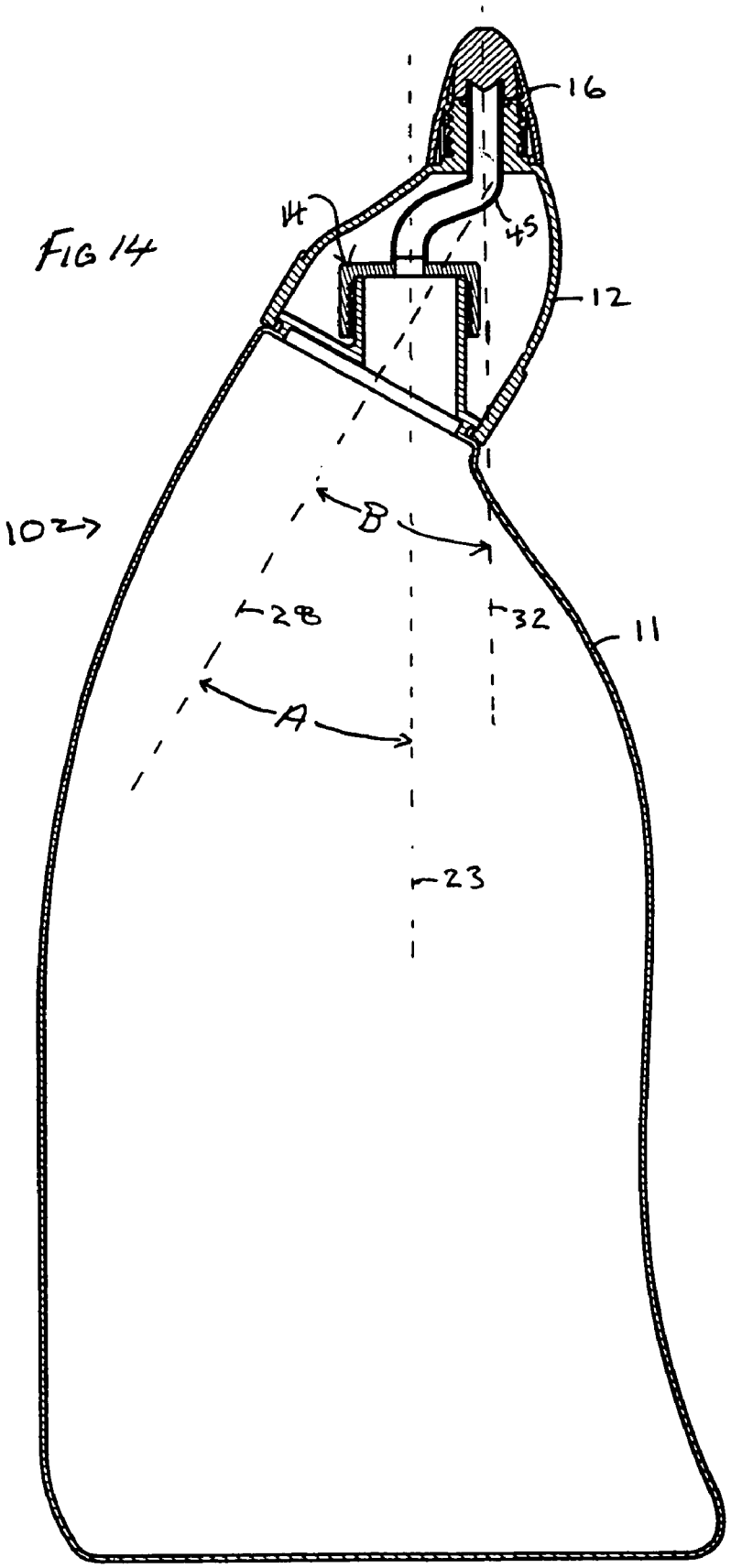
FIG. 14 is a cross-sectional view of the container of FIG. 13 along section line 2-2' in FIG. 13.

FIGS. 2, 3 and 4 show the container 10 in a first position in which the vertical axis 23, the pivot axis 28 and the outlet axis 32 lie in the same plane being the plane of the cross-section 4-4' of FIG. 4. The outlet axis 32 forms an angle indicated as "B" with respect to the pivot axis 28. FIGS. 12, 13 and 14 illustrate the container of FIG. 1 in a second position in which the turret member 12 has been rotated 180° relative to the bottle 11 from the first position shown in FIGS. 1 to 4. In FIGS. 12, 13 and 14, the vertical axis 23, the pivot axis 28 and the outlet axis 32 also lie in the same cross-sectional plane 2-2' in FIG. 14. In FIG. 14, as in FIG. 4, the pivot axis 28 is the angle "A" to the vertical axis 23 and the pivot axis 28 is at the same angle "B" to the outlet axis 32. In Figure the outlet axis 32 is parallel to the vertical axis 23 which occurs since angle "A" has been selected to be equal angle "B". As seen in cross-section in FIG. 14, the tube member 45 of the connection tube 14 has become deformed and bent so as to assume a generally "S" shape and maintains sealed communication between the interior of the bottle 11 and the turret outlet 31.

Figure 15:
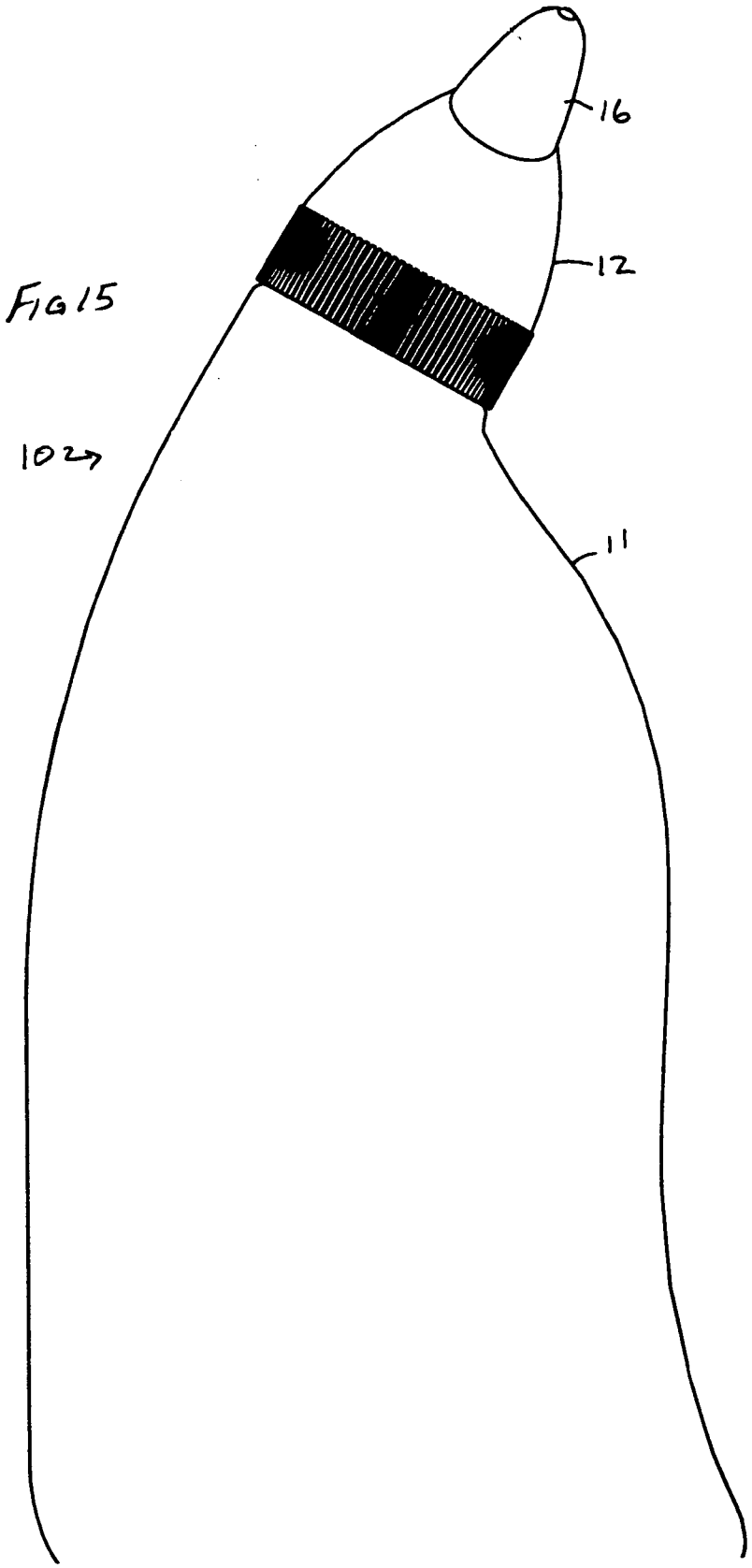
FIG. 15 is a side view of the container of FIG. 1 however with the turret member rotated to a position intermediate the positions illustrated in FIGS. 2 and 12.
Figure 16:
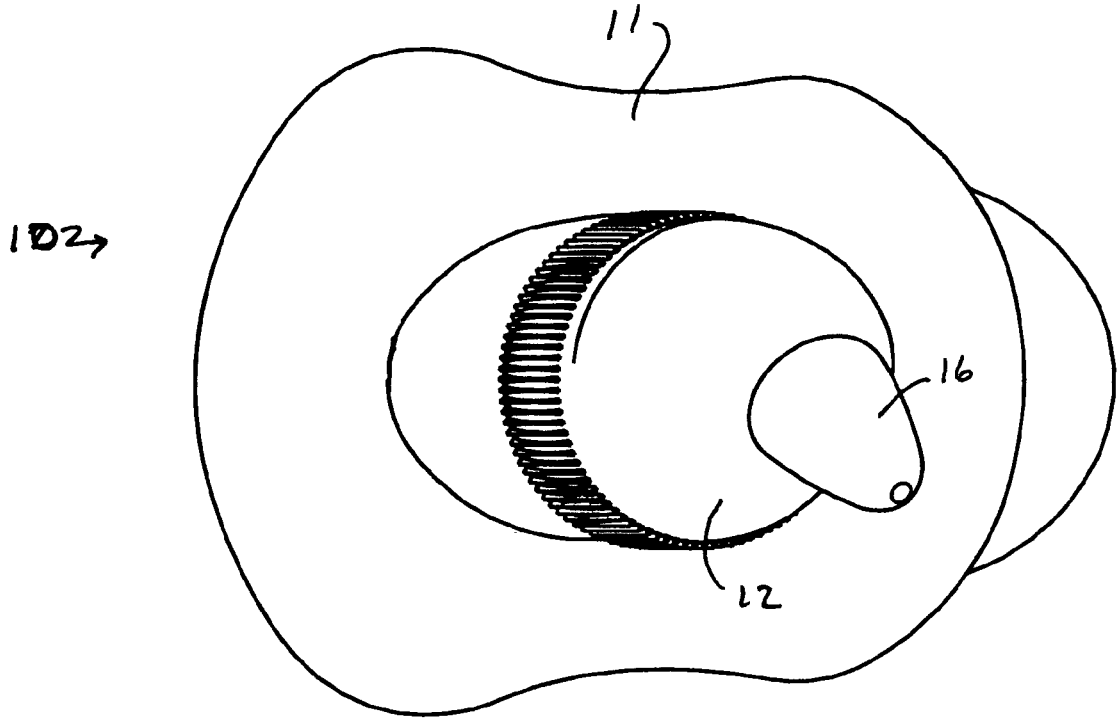
FIG. 16 is a top view of the container in FIG. 15.

Reference is made to FIGS. 15 and 16 which illustrates the container 10 with the turret member 12 in one intermediate position between the first position of the turret member in FIG. 2 and the second position of the turret member 12 in FIG. 12.

In order to accommodate the relative pivoting of the turret member 12 relative to the filling neck 22, the tube member 45 of the connection tube 14 is preferably resilient so as to assume different relative shapes including those illustrated in cross-section of FIGS. 4 and 14. As well, preferably, the outlet end 46 of the tube member 45 is received in the turret outlet 31 for relative coaxial rotation of the tube member 45 within the turret outlet 31 about the outlet axis 32. While not necessary, this is preferred so as to permit the turret member 12 to be rotated relative to the bottle 11 through multiple rotations of 360° and avoid the connection tube 14 become closed as by twisting and thereby closure of the tube member 45.

Figure 17:
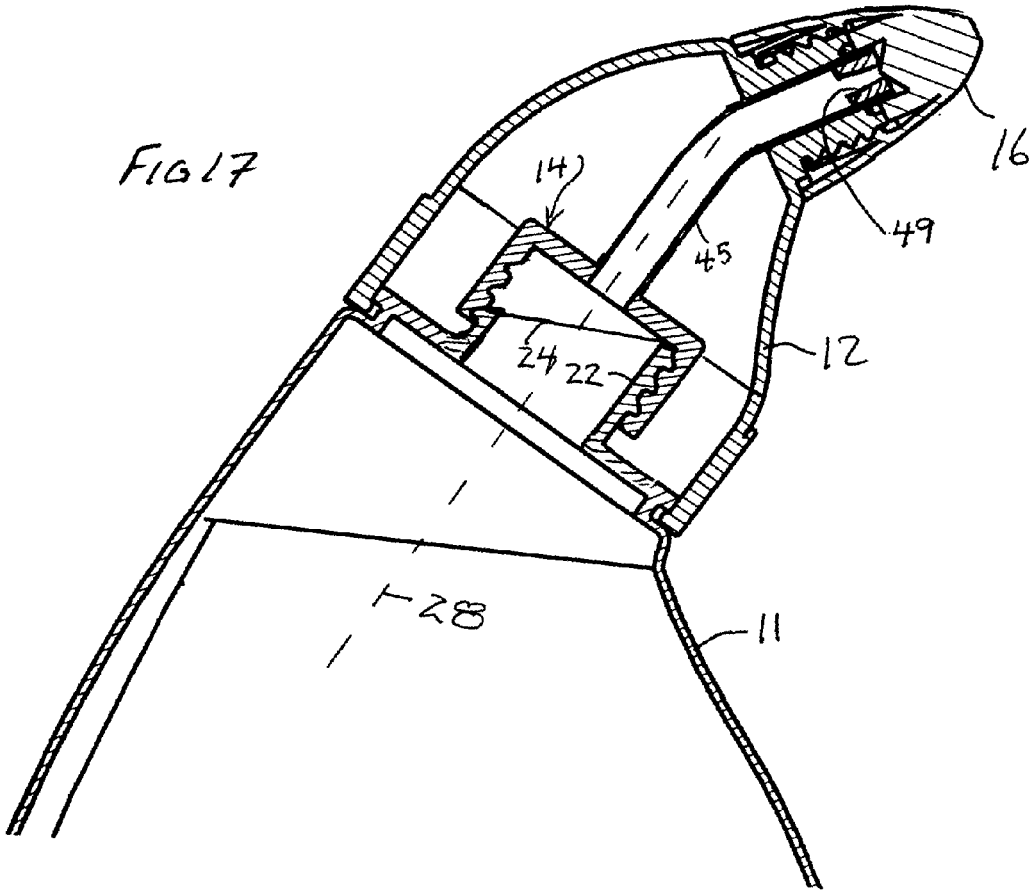
FIG. 17 is a cross-sectional side view similar to FIG. 4 but of a second embodiment in which the filling neck is disposed parallel to the pivot axis for the turret member.

The outlet end 46 of the tube member 45 effectively forms a nozzle which is engaged within the turret outlet 31 and directs fluids therethrough in directions preferably generally parallel to the outlet axis 32. It is preferred that the nozzle directs fluids through the turret outlet 31 in directions which form an acute angle to the pivot axis 28 and therefore not parallel to the pivot axis 28. As illustrated in FIG. 17, within the outer end 46 of the tube member 45, a separate nozzle member 49 may be provided as for example to dispense a spray.

In a preferred first embodiment, as illustrated in FIG. 4, the angle "A" between the pivot axis 28 and the vertical axis 23 and the angle "B" between the pivot axis 28 and the outlet axis 32 is shown to be equal such that when a second position is assumed as illustrated in FIG. 14, the outlet axis 32 is parallel to the vertical axis 23 and thus fluid would be dispensed vertically. This is not necessary and various different angles for the angles indicated as "A" and "B" may be selected. Preferably, the angle "A" is in the range of about 20° to 50° and the angle "B" is similarly in the range of about 20° to 50°. Angles "A" and "B" may be equal but this is not necessary.

With the first embodiment illustrated in FIGS. 1 to 16, on rotation of the turret member 12 on the collar 26 coaxially about the pivot axis 28, the outlet axis 32 assumes positions in which the outlet axis 32 is directed in different directions relative to the pivot axis 28 and in which the outlet axis 32 forms different angles relative to the vertical axis 23. Thus, in rotation of the turret member 180° from the first position shown in FIG. 4 to the second position shown in FIG. 14, the outlet axis 32 will assume continuing different angles relative to the vertical axis 23 as for example seen in side view. Of course, the relative angle between the pivot axis 28 and the outlet axis 32 will remain constant however relative the pivot axis 28, rotation of the turret member will direct the outlet axis 32 to be directed in different directions relative the pivot axis 28.

The first embodiment as illustrated in FIGS. 1 to 4 is adapted for use with a bottle 11 which may be manually squeezed and on being manual squeezed pressure created within the bottle 11 will urge fluid out of the turret outlet 31. The container 10 in the first embodiment is adapted for use when inverted however if desired the container 10 may be modified for use as in an upright position.

The preferred embodiments shown illustrate the turret member 12 as being mounted to the bottle 11 for rotation about the pivot axis. This is not necessary and a bottle 11 may be provided as for example illustrated in FIG. 4 with the turret member 12 fixed to the bottle 11 against rotation in the position shown in FIG. 4 or other positions.

The preferred embodiment of FIGS. 1 to 16 illustrate the bottle 12 as having its filling neck 22 extends vertically about the vertical axis 23. FIG. 17 illustrates a cross-sectional side view similar to that of FIG. 4 but of a second embodiment in which the filling neck 22 is disposed to not be vertical when the bottle is in the upright position but rather to be at an angle to the vertical and coaxial to the pivot axis 28. FIG. 17 illustrates that while the filling neck 22 is disposed to not be vertical, the open upper end 24 of the filling neck 22 may be disposed to extend generally horizontal as can be of assistance for automatic filling with the bottle in an upright position increasing the horizontal area through which a vertical filling tube may be accommodated.

Figure 18:
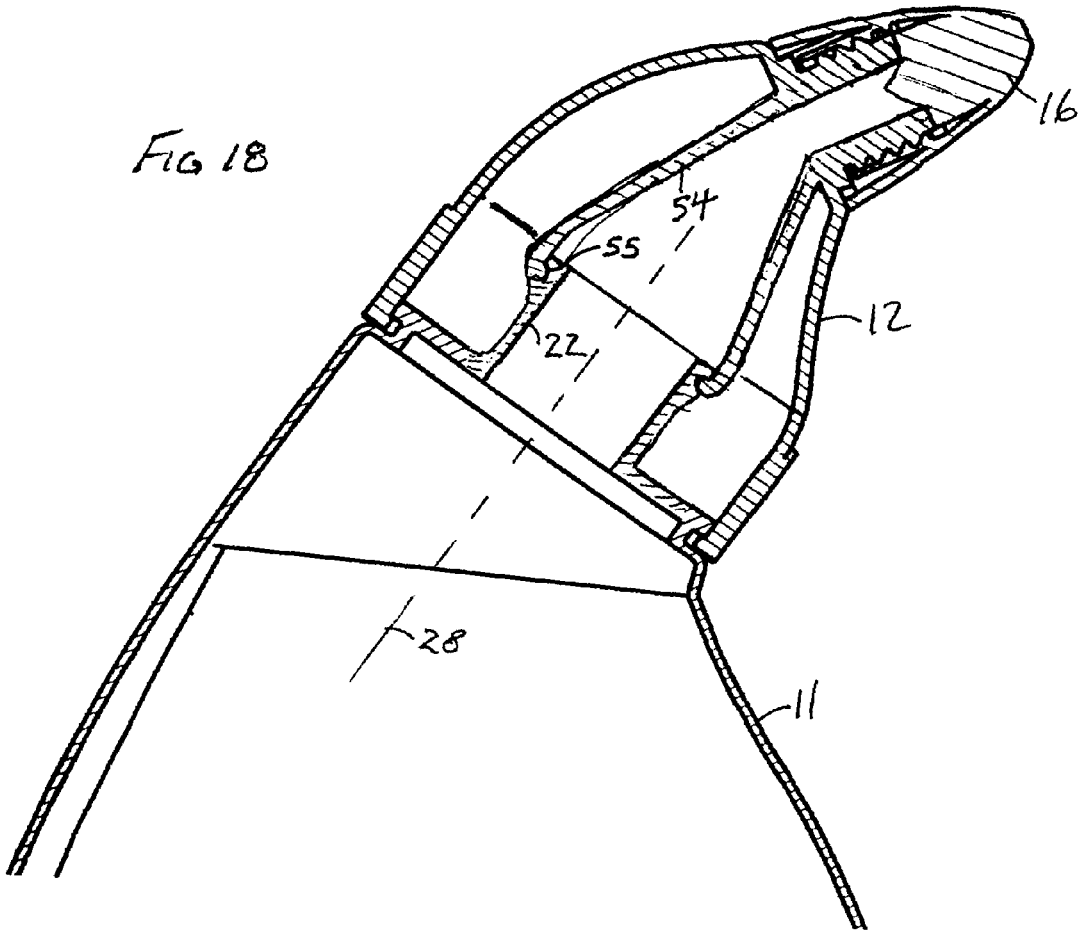
FIG. 18 is a cross-sectional side view similar to FIG. 4 but of a third embodiment in which the filling neck is disposed parallel to the pivot axis for the turret member.

Reference is made to FIG. 18 which illustrates a third embodiment in a cross-section similar to that shown in FIG. 4. In the third embodiment, the equivalent to the connection tube is formed integrally with the turret member 12. In this embodiment, the filling tube 22 is coaxial with the pivot axis 28 and the turret member 12 is effectively provided to have an integral internal tube 54 which engages on annular rim 55 of the filling neck 22 and form a substantially fluid impermeable journalled seal therewith. While the internal tube 54 is shown to engage about the exterior of the filling neck 22, the internal tube 54 may be modified to engage internally within the filling neck 22.

Many variations and modifications will now occur to persons skilled in the art. For a definition of the invention reference is made to the following claims.

We claim:

1. A container comprising:

a resilient bottle to dispense fluid contained therein when manually squeezed, the bottle having a lower end and an upper end, the bottle having a base at its lower end adapted to support the bottle on a flat surface in the upright position with the bottle extending upwardly from the base, a filling neck at the upper end of the bottle extending vertically upwardly about a vertical axis to an upper open end when the bottle is in the upright position supported on its base, a support collar on the container about the filler neck, the support collar being coaxial about a pivot axis disposed at an acute angle to the vertical axis, a turret member extending from an open lower end to an upper end, the upper end of the turret member carrying a turret outlet disposed about an outlet axis, the lower end of the turret member being mounted on the collar with the turret member enclosing the filling neck, the lower end of the turret member being mounted on the collar coaxially relative to the pivot axis for rotation of the turret member relative the collar about the pivot axis, the outlet axis disposed at an acute angle to the pivot axis.

2. A container as claimed in claim 1 including a connection tube inside the turret member providing communication from the open end of the filling neck to the turret outlet.

3. A container as claimed in claim 2 wherein on rotation of the turret member on the collar coaxially about the pivot axis the outlet axis assumes positions in which the outlet axis is directed in different directions relative to the pivot axis and in which the outlet axis forms different angles relative the vertical axis.

4. A container as claimed in claim 3 including a removable closure cap coupled to the upper outlet end of the turret member to close the outlet tube.

5. A container as claimed in claim 2 wherein the connection tube is flexible to accommodate changes in distance of the outlet opening from the filling neck with rotation of the turret member.

6. A container as claimed in claim 5 wherein the connection tube has a tube outer end, engaged within the turret outlet for relative coaxial rotation of the tube outer end within the turret outlet about the outlet axis.

7. A container as claimed in claim 5 wherein the connection tube has a tube inner end coupled to the filling neck to sealably close the same but for communication via the connection tube to the turret outlet.

8. A container as claimed in claim 5 wherein the connection tube has at a tube outer end a nozzle, the nozzle being engaged within the turret outlet for relative coaxial rotation of nozzle within the turret outlet about the outlet axis.

9. A container as claimed in claim 8 wherein the nozzle directs fluid therethrough in directions generally parallel to the outlet axis, or, not parallel to the pivot axis.

10. The container as claimed in claim 1 wherein the turret member is received in the collar support in a snap fit arrangement restricting removal of the turret member from the collar but permitting relative rotation of the turret member on the collar about the pivot axis.

11. A container as claimed in claim 1 wherein the tube member includes a cap portion for sealable engagement with the filling neck and providing communication to an elongate tube of a reduced diameter relative to the filling neck which tube is sized to be securely received within the turret outlet.

12. A container as claimed in claim 4 wherein the closure cap is provided with a mechanism to resist ease of removal by children.

13. A container as claimed in claim 1 wherein the turret member is received on the collar in a manner in which permits relative rotation of the turret member about the collar about the pivot axis however with frictional engagement therebetween such that when the turret member is located at any one relative position, forces are required to be applied to the turret member to rotate it to a different relative position on the collar.

14. A container as claimed in claim 11 including a nozzle member received in the end of the tube member where the tube extends from the turret outlet.

15. A container as claimed in claim 1 wherein the bottle comprises a resilient bottle adapted to be inverted and manually squeezed so as to force fluid contained in the bottle out of the turret outlet.

16. A container as claimed in claim 1 comprising a toilet bowl cleaner receptacle and dispenser for dispensing liquid from the bottle when inverted upwardly underneath a rim of a toilet bowl adjacent the upper opening to a toilet bowl.

17. A container as claimed in claim 1 the turret member is a hollow tubular member tapering from the open lower end to the upper end about a centerline which is asymmetrical relative to the pivot axis.

18. A container as claimed in claim 17 wherein the turret outlet is coaxial with the centerline.

19. A container as claimed in claim 18 wherein the hollow tubular member is generally circular in any cross section normal to the centerline.

20. A container as claimed in claim 18 wherein the turret member is a hollow tubular member of generally curved horn-type shape tapering from the open lower end to the upper end.

21. A container as claimed in claim 1 which requires inversion from the upright position for dispensing fluid.

22. A container as claimed in claim 21 comprising a container for cleaner for toilet bowls.

* * * * *